US010753682B2

(12) United States Patent
Demolliens et al.

(10) Patent No.: US 10,753,682 B2
(45) Date of Patent: Aug. 25, 2020

(54) FACILITY AND METHOD FOR PRODUCING LIQUID HELIUM

(71) Applicant: L'Air Liquide, Societe Anonyme pour I'Etude et I'Exploitation des Procedes Georges Claude, Paris (FR)

(72) Inventors: Bertrand Demolliens, La Queue en Brie (FR); Jean-Marc Bernhardt, La Buisse (FR); Rawia Ali Said, Grenoble (FR); Delphine Pichot, Paris (FR); Antoine Hernandez, La Queue en Brie (FR); Jean-Marc Tsevery, Lieusaint (FR); Jean-Marc Peyron, Creteil (FR)

(73) Assignee: L'Air Liquide Societe Anonyme Pour L'Etude Et L'Exploitation Des Procedes Georges Claude, Paris (FR)

( * ) Notice: Subject to any disclaimer, the term of this patent is extended or adjusted under 35 U.S.C. 154(b) by 129 days.

(21) Appl. No.: 15/567,152

(22) PCT Filed: Apr. 13, 2016

(86) PCT No.: PCT/FR2016/050846
§ 371 (c)(1),
(2) Date: Oct. 17, 2017

(87) PCT Pub. No.: WO2016/166468
PCT Pub. Date: Oct. 20, 2016

(65) Prior Publication Data

US 2018/0100696 A1 Apr. 12, 2018

(30) Foreign Application Priority Data

Apr. 17, 2015 (FR) ..... 15 53430

(51) Int. Cl.
*F25J 3/06* (2006.01)
*F25J 1/00* (2006.01)
*F25J 1/02* (2006.01)

(52) U.S. Cl.
CPC ..... *F25J 3/069* (2013.01); *F25J 1/0007* (2013.01); *F25J 1/0037* (2013.01); *F25J 1/0224* (2013.01);
(Continued)

(58) Field of Classification Search
CPC .. F25J 1/0007; F25J 3/069; F25J 3/066; F25J 1/0037; F25J 1/0224; F25J 1/0237; F25J 1/0259
(Continued)

(56) References Cited

U.S. PATENT DOCUMENTS 3,324,626 A 6/1967 Thorpe et al.
3,407,614 A 10/1968 Poska
(Continued)

FOREIGN PATENT DOCUMENTS

FR 2 954 973 7/2011

OTHER PUBLICATIONS

International Search Report and Written Opinion for PCT/FR2016/50846, dated Mar. 8, 2016.
(Continued)

*Primary Examiner* — Joel M Attey
(74) *Attorney, Agent, or Firm* — Christopher J. Cronin

(57) ABSTRACT

The invention relates to a facility for producing liquid helium from a source gas mixture substantially comprising nitrogen and helium. The facility includes a cryogenic purifier including a system for separating the nitrogen from the source gas mixture with a view to producing helium at a temperature lower than the temperature of the source gas. The facility also includes a helium liquefier that subjects the
(Continued)

helium to a work cycle including, in series: compressing the helium, cooling and decompressing the compressed helium, and reheating the cooled, decompressed helium. The facility includes a helium transfer pipe connecting an outlet of the purifier to an inlet of the liquefier in order to transfer helium produced by the purifier into the work cycle of the liquefier. The facility is characterized in that the cryogenic purifier includes a decompression system that includes an inlet to be connected to a source of pressurized nitrogen gas. Said system for decompressing the nitrogen gas exchanges heat with the separation system in order to transfer cold from the decompressed nitrogen gas to said separation system.

19 Claims, 2 Drawing Sheets

(52) U.S. Cl.
CPC ..... *F25J 1/0237* (2013.01); *F25J 1/0259* (2013.01); *F25J 3/066* (2013.01); *F25J 2205/40* (2013.01); *F25J 2205/60* (2013.01); *F25J 2210/42* (2013.01); *F25J 2215/04* (2013.01); *F25J 2220/02* (2013.01); *F25J 2240/12* (2013.01); *F25J 2260/20* (2013.01); *F25J 2270/06* (2013.01); *F25J 2270/16* (2013.01); *F25J 2270/904* (2013.01)

(58) Field of Classification Search
USPC ..... 62/608
See application file for complete search history.

(56) References Cited

U.S. PATENT DOCUMENTS

| | | | | |
|---|---|---|---|---|
| 4,048,814 | A * | 9/1977 | Quack | F25B 9/10 62/335 |
| 4,659,351 | A * | 4/1987 | Stuber | F25J 1/0007 62/48.2 |
| 4,666,481 | A | 5/1987 | Olson, Jr. | |
| 4,701,200 | A | 10/1987 | Fisher et al. | |
| 2004/0255618 | A1 | 12/2004 | Pelle et al. | |

OTHER PUBLICATIONS

French Search Report and Written Opinion for FR 1 553 430, dated Mar. 4, 2016.

* cited by examiner

FACILITY AND METHOD FOR PRODUCING LIQUID HELIUM

CROSS-REFERENCE TO RELATED APPLICATIONS

This application is a § 371 of International PCT Application PCT/FR2016/050846, filed Apr. 13, 2016, which claims § 119(a) foreign priority to French patent application FR1553430, filed Apr. 17, 2015.

BACKGROUND

Field of the Invention

The present invention relates to a facility and a process for producing helium.

The invention relates to helium purification and liquefaction.

The invention relates more particularly to a facility for producing liquid helium from a source gas mixture essentially comprising nitrogen and helium, the facility comprising a cryogenic purifier comprising a circuit for separating nitrogen from the source gas mixture with a view to producing helium at a temperature below the temperature of the source gas, the facility additionally comprising a helium liquefier that subjects the helium to a work cycle comprising in series: a compression of the helium, a cooling and an expansion of the compressed helium and a reheating of the cooled and expanded helium, the facility comprising a helium transfer line that connects an outlet of the purifier to an inlet of the liquefier in order to transfer helium produced by the purifier to the work cycle of the liquefier.

The invention relates in particular to the production of liquid helium in facilities that generate a mixture of helium and nitrogen and optionally other residues.

This gas source, substantially formed of nitrogen and helium in equal parts, may in particular be available in a natural gas production plant.

Related Art

In this type of facility, nitrogen, which has been separated from the natural gas upstream, is generally available.

Liquid nitrogen may be used in helium liquefaction units. This makes it possible to reduce the size of the helium work cycle since, in this case, the helium from the liquefaction cycle may be cooled only between 80 K and 4 K approximately (rather than from ambient temperature to 4 K). Nevertheless, this solution requires adding an additional exchanger to the facility and a vessel for vaporizing the liquid nitrogen in a vacuum box in order to recover the cold from the liquid nitrogen.

The vacuum cold box of the liquefier also typically comprises adsorbers in order to strip the helium of the traces of atmospheric gas in order to prevent these traces from freezing in the downstream part of the process. These traces of atmospheric gas may decide the dimensions of the vacuum box.

SUMMARY OF THE INVENTION

One objective of the present invention is to overcome all or some of the drawbacks of the prior art raised above.

To this end, the facility according to the invention, furthermore in accordance with the generic definition given in the preamble above, is essentially characterized in that the cryogenic purifier comprises an expansion circuit comprising an inlet intended to be connected to a source of pressurized gaseous nitrogen, said circuit for expanding the gaseous nitrogen being in heat exchange with the separation circuit in order to transfer frigories from the expanded gaseous nitrogen to said separation circuit.

Furthermore, embodiments of the invention may comprise one or more of the following features:

- the separation circuit of the purifier comprises at least one heat exchanger in heat exchange with the source gas mixture with a view to the cooling thereof and at least one separator vessel, the circuit (8) for expanding the pressurized gaseous nitrogen is in heat exchange with the at least one heat exchanger of the separation circuit,
- the circuit (8) for expanding the pressurized gaseous nitrogen comprises at least two turbines for expanding the gaseous nitrogen and two separate portions in heat exchange with the at least one heat exchanger of the separation circuit, the two separate portions being located respectively downstream of the two expansion turbines,
- the separation circuit comprises at least one adsorption-type purification device for separating the nitrogen from the mixture,
- the helium liquefier comprises a compression station intended to carry out the compression of the helium in the work cycle and a cold box intended to carry out a cooling and an expansion of the helium compressed in the work cycle, the device for cooling the cycle helium originating from the compression station being incorporated in the cryogenic purifier in a thermally insulated common housing, the cold box of the liquefier is located in a thermally insulated separate housing that comprises vacuum insulation,
- at least one part of the compression station is incorporated in the cryogenic purifier (3) in a thermally insulated common housing that is separate from the housing incorporating the cold box of the liquefier,
- the cold box of the helium liquefier contains four turbines for expanding helium gas in the work cycle and the compression station contains a compressor stage of the work gas in the work cycle.

The invention also relates to a process for producing liquid helium from a source gas mixture essentially comprising nitrogen and helium using a facility in accordance with any one of the features above or below, wherein the source gas mixture comprising nitrogen and helium in molar concentrations respectively between 50% and 65% (for example between 55% and 60%, in particular 57%) and 35% and 50% (for example between 40% and 45%, in particular 42%), the source gas mixture optionally residually comprising at least one of the elements below: argon, oxygen, neon in proportions for example between 0.15% and 0.5%, in particular 0.22%, this source gas mixture having a pressure between 15 and 35 bar and a temperature between 273 and 323 K, and for example 300 K.

According to other possible distinctive features:

- the gaseous nitrogen inlet of the purifier is supplied with pressurized gaseous nitrogen at a pressure between 15 and 50 bar, for example 40 bar and a temperature between 273 and 323 K,
- the helium produced by the purifier at its outlet has a pressure between 15 and 35 bar and a temperature for example between 77 and 90 K and for example 80 to 85 K, in particular 82 K, the helium liquefier is configured to only cool the helium in the work cycle from the value of the temperature at the outlet of the purifier to the temperature of 4 K.

The invention may also relate to any alternative device or process comprising any combination of the features above or below.

Other distinctive features and advantages will become apparent on reading the description below, given with reference to the figures in which:

DETAILED DESCRIPTION OF THE INVENTION

Figure 1:
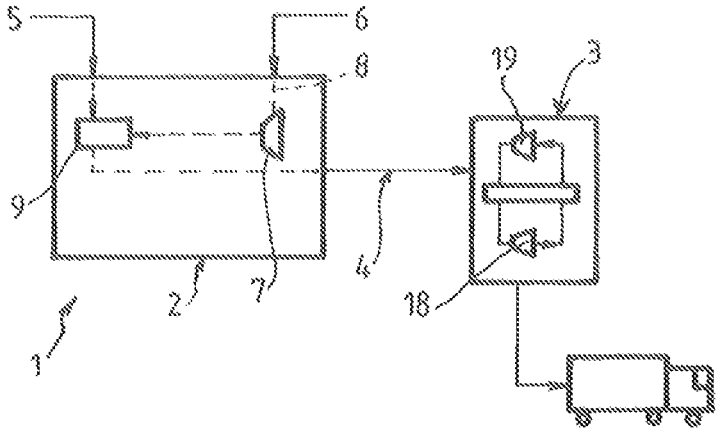
FIG. 1 represents a schematic and partial figure illustrating the structure and the operation of the facility according to the invention.

The facility 1 for producing liquid helium represented schematically in FIG. 1 comprises a cryogenic purifier 2 (cryogenic upgrader). This purifier 2 is supplied with a source gas mixture 5 (helium and nitrogen) in order to produce, after purification (cryogenic separation), pure or virtually pure helium, that is to say helium capable of supplying a helium liquefier 3.

For example, the nitrogen and helium are present in this source gas mixture in molar concentrations respectively between 50% and 65% (for example between 55% and 60%, in particular 57%) and 35% and 50% (for example between 40% and 45%, in particular 42%). The source gas mixture optionally residually comprises at least one of the elements below (argon, oxygen, neon) in proportions for example between 0.15% and 0.5% (in particular 0.22%). This source gas mixture may have a pressure between 15 and 35 bar and a temperature between 273 and 323 K and for example 300 K.

The purifier 2 conventionally comprises a circuit 9 for separating nitrogen from the source gas mixture with a view to producing helium at a temperature below the temperature of the source gas. The separation circuit 9 conventionally comprises steps of cooling (in particular by heat exchange with a cooling exchanger 10) and one or more passes through a separator vessel 11, 12, and an expansion (valve 20). Furthermore, the mixture may undergo one or more steps of purification via adsorption (via one or more devices 14, 15 of "PSA" pressure swing adsorption type in particular) in order to strip the mixture of its nitrogen.

Figure 2:
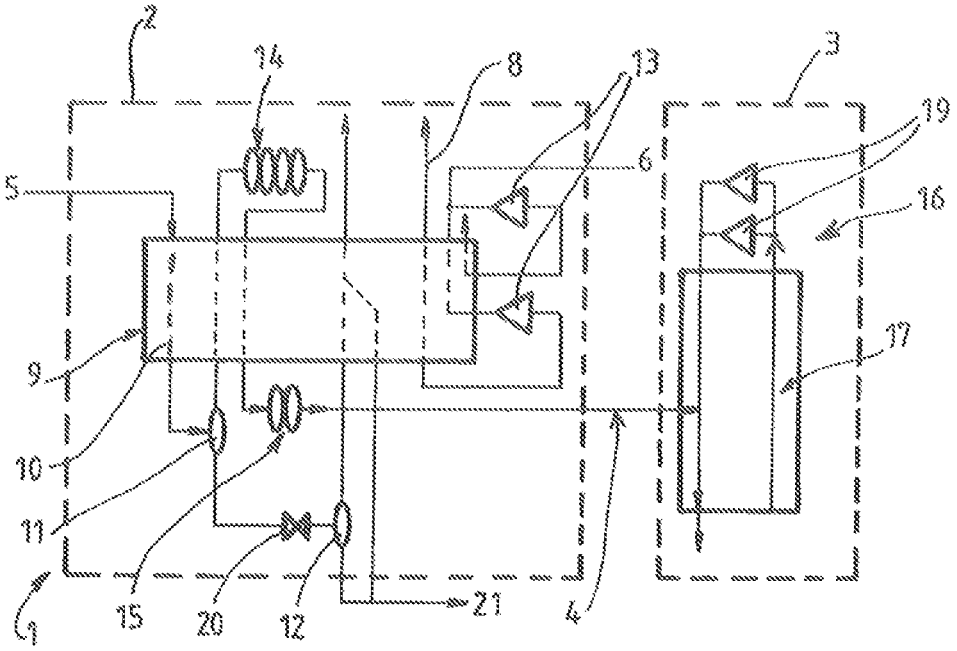
FIGS. 2 and 3 illustrate, schematically and partially, the structure and operation of two examples of possible implementation of the invention.

As seen in FIG. 2, the separation circuit 9 of the purifier 2 may comprise at least one heat exchanger 10 in heat exchange with the source gas mixture with a view to the cooling thereof and two separator vessels 11, 12. The nitrogen recovered, in particular the liquefied nitrogen 21 obtained may be recovered in a recovery tank (not represented in the figures).

The circuit 8 for expanding the pressurized gaseous nitrogen may be in heat exchange with the at least one heat exchanger 10 of the separation circuit 9.

The purifier may in particular have no distillation column.

The facility 1 additionally comprises a helium liquefier 3 that conventionally subjects helium to a work cycle comprising in series: a compression of the helium (in a compression station), a cooling and an expansion of the compressed helium (in a cold box) and a reheating of the cooled and expanded helium with a view to returning it to the compression station to restart a cycle.

The facility 1 comprises a helium transfer line 4 that connects an outlet of the purifier 2 to an inlet of the liquefier 3. This transfer line 4 is provided to transfer helium produced by the purifier 2 to the work cycle of the liquefier 3.

According to one advantageous distinctive feature, the cryogenic purifier 2 comprises a gaseous nitrogen inlet intended to be connected to a source 6 of pressurized gaseous nitrogen available in the facility.

As illustrated in FIG. 2, the purifier 2 comprises to this effect a circuit 8 for expanding 7 the pressurized gaseous nitrogen. This expansion circuit 8 is in heat exchange with the separation circuit 9 to enable the transfer of frigories from the expanded gaseous nitrogen to said separation circuit 9. That is to say that energy from the gaseous nitrogen is transferred in the process for purifying and cooling the source mixture.

More specifically, the circuit 8 for expanding 7 the pressurized gaseous nitrogen may be in heat exchange with the heat exchanger 10 of the separation circuit 9, in order to supply frigories used in the cryogenic separation of the nitrogen from the source mixture.

The circuit 8 for expanding 7 the pressurized gaseous nitrogen may comprise one or preferably at least two turbines 13 for expanding the gaseous nitrogen and two separate portions in heat exchange with the heat exchanger 10 of the separation circuit 9. The two separate portions in heat exchange with the exchanger 10 are located for example respectively downstream of the two turbines 13 for expanding the nitrogen.

This pressurized gaseous nitrogen is for example available at a pressure between 15 and 50 bar (for example 40 bar) and a temperature between 273 and 323 K.

The helium produced by the purifier 3 at its outlet has a pressure for example between 15 and 35 bar and a temperature for example between 77 and 90 K and for example 80 to 85 K. (82 K typically).

According to this configuration, the helium produced by the purifier 2 is returned cold directly to the work cycle of the liquefier 3. This makes it possible to reduce the cooling capacity of the liquefier 3 since it only needs to cool the helium between 80 K (temperature of the helium provided by the purifier 2) and 4 K (the target low liquefaction temperature).

According to the known processes, this helium had to be cooled from ambient temperature (300 K approximately) down to 4 K.

The invention makes it possible to reduce the size and capacity of the liquefier 3 of the facility 1.

Thus, the liquefier 3 may operate in "refrigerator" mode in the part of the cycle between 300 K and 80 K (that is to say that in this part of the work cycle there is as much helium that is cooled/expanded at the outlet of the compression station as there is helium that is reheated and returns to the compression station). On the other hand, between 80 K and 4 K the liquefier may operate in "liquefier" mode (that is to say that there is more helium which is in the expansion/cooling phase than in the phase of reheating and returning to the compression station).

This "refrigerator" operating mode in the part of the cycle between 300 K and 80 K is much more energy-efficient than the "liquefier" operating mode since the fluid flow rates are balanced in the work cycle (in both directions).

Specifically, this solution makes it possible to "transfer" refrigerating capacity from 300 K to 80 K from the compression station of the liquefier 3 to the nitrogen compressor of the purifier 2.

The compression of nitrogen (in particular by centrifugal compressor(s)) is much more energy-efficient than the compression of helium (in particular by oil-injected screw compressor(s)). Furthermore, the efficiency of the motor of a nitrogen compressor (which is much more powerful) will be better than that of a screw compressor. Specifically, the efficiency of a compressor motor increases with its size.

The energy efficiency of the facility 1 will therefore be improved by this change.

Obtaining cold (80 K) helium at the outlet of the purifier 2 also makes it possible to eliminate the two hot expansion turbines in the liquefier 3. These two turbines may be replaced by two nitrogen turbines on the purifier 2 side.

These two turbines 13 for nitrogen (typically oil-bearing turbines) are more efficient and less complex to produce than gas-bearing turbines for helium in the liquefier 3.

By eliminating two first turbines 18 in the liquefier 3, it is possible to considerably reduce the rate of return to medium pressure in the helium work cycle of the liquefier 3.

Another optimization of the liquefier 3 may make it possible to eliminate the return of helium to intermediate pressure in the work cycle of the liquefier 3. This may enable the liquefier 3 to operate with a single cycle compressor that will work for example between 1 bar and 15 bar. This cycle compressor 19 may also consist of only a single oil-injected screw.

These improvements therefore make it possible to considerably reduce the cycle compressor requirements in the liquefier 3. The pressure of the cycle is thus also divorced from the feed pressure. This makes it possible to have an additional freedom parameter in order to optimize the overall plant incorporating this facility.

The adsorbers 15 of the purifier 2 (for example at a temperature of 80 K) may be incorporated into a thermally insulated cold box (conventionally insulated with perlite, the casing will preferably be insulated with rock wool in practice in order to retain the option of intervening for maintenance). This makes it possible to reduce the size of the vacuum cold box.

The regeneration of these adsorbers may be carried out with gas at the outlet of the PSA(s) 14 at ambient temperature. The (re)cooling of the purification cylinder containing the adsorber after the regeneration could be carried out by helium at the outlet (or at the inlet) of said in-line cylinder.

A portion of liquid nitrogen 21 produced may be drawn off from the facility 1. This liquid nitrogen may be consumed for other requirements in the plant (trucks, etc.).

Figure 3:
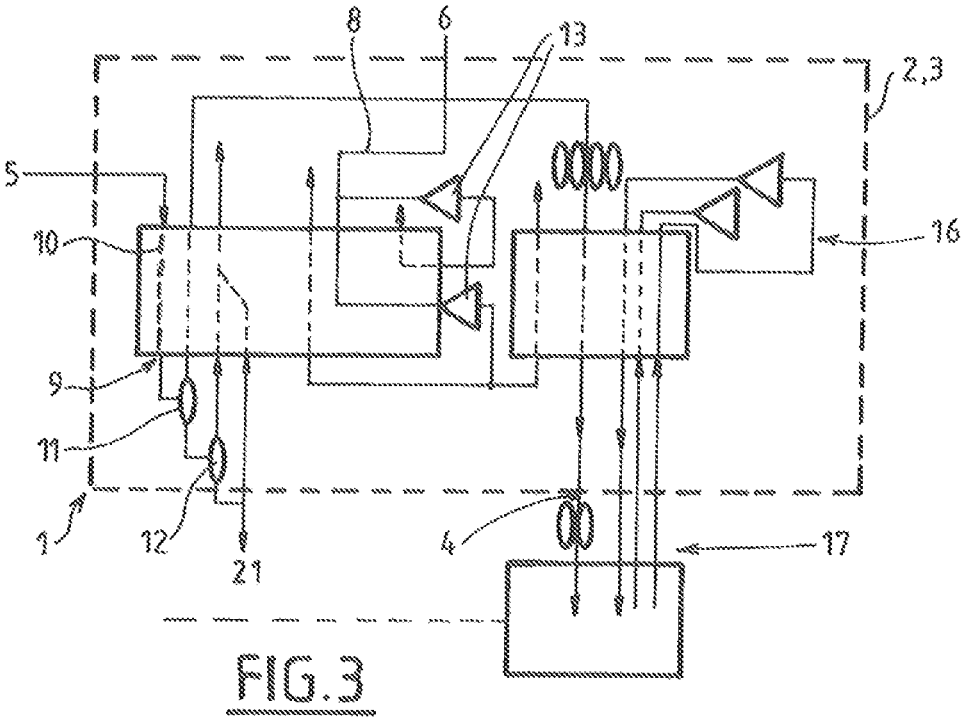

FIG. 3 represents a variant embodiment which differs from that of FIG. 2 only in that the initial cooling of the cycle helium originating from the compression station 16 of the liquefier 3 is incorporated into the cryogenic purifier 2 in a thermally insulated common housing whilst the cold box 17 of the liquefier 3 is located in a thermally insulated separate housing that comprises vacuum insulation.

That is to say that all the fluids having a temperature above 80 K are incorporated into one or more perlite-filled (insulated) cold boxes whereas the fluids having a temperature below 80 K are incorporated into a vacuum insulated cold box. This also makes it possible to reduce the size of the vacuum insulated cold box of the facility.

The cold box containing all the pieces of equipment may be insulated with perlite whereas the cold box containing the cryogenic adsorbers may be insulated with rock wool.

According to one distinctive feature, it is possible to share the pieces of equipment that enable the regeneration of the cold adsorbers between the liquefier and the purifier. It is possible to recool the adsorber after regeneration with the gas at the inlet and not only with the gas at the outlet.

While the invention has been described in conjunction with specific embodiments thereof, it is evident that many alternatives, modifications, and variations will be apparent to those skilled in the art in light of the foregoing description. Accordingly, it is intended to embrace all such alternatives, modifications, and variations as fall within the spirit and broad scope of the appended claims. The present invention may suitably comprise, consist or consist essentially of the elements disclosed and may be practiced in the absence of an element not disclosed. Furthermore, if there is language referring to order, such as first and second, it should be understood in an exemplary sense and not in a limiting sense. For example, it can be recognized by those skilled in the art that certain steps can be combined into a single step.

The singular forms "a", an and the include plural referents, unless the context dearly dictates otherwise.

"Comprising" in a claim is an open transitional term which means the subsequently identified claim elements are a nonexclusive listing i.e. anything else may be additionally included and remain within the scope of "comprising."

"Comprising" is defined herein as necessarily encompassing the more limited transitional terms "consisting essentially of" and "consisting of"; "comprising" may therefore be replaced by "consisting essentially of" or "consisting of" and remain within the expressly defined scope of "comprising".

"Providing" in a claim is defined to mean furnishing, supplying, making available, or preparing something. The step may be performed by any actor in the absence of express language in the claim to the contrary.

Optional or optionally means that the subsequently described event or circumstances may or may not occur. The description includes instances where the event or circumstance occurs and instances where it does not occur.

Ranges may be expressed herein as from about one particular value, and/or to about another particular value. When such a range is expressed, it is to be understood that another embodiment is from the one particular value and/or to the other particular value, along with all combinations within said range.

All references identified herein are each hereby incorporated by reference into this application in their entireties, as well as for the specific information for which each is cited.

What is claimed is:

1. A facility for producing liquid helium comprising:

a source of a source gas mixture comprising nitrogen and helium;

a source of pressurized gaseous nitrogen;

a cryogenic purifier comprising a circuit for separating nitrogen from the source gas mixture for the production of helium at a temperature below a temperature of the source gas mixture, the circuit for separating nitrogen from the source gas mixture comprising at least one heat exchanger in heat exchange with the source gas mixture;

a helium transfer line that receives the helium produced by the cryogenic purifier; and a helium liquefier receiving the helium from the helium transfer line, the helium transfer line connecting an outlet of the cryogenic purifier to an inlet of the helium liquifer, the helium liquefier subjecting the helium to a work cycle comprising in series: a compression of the helium, a cooling and an expansion of the compressed helium and a reheating of the cooled and expanded helium, wherein:

the cryogenic purifier further comprises an expansion circuit that comprises an inlet connected to the source of pressurized gaseous nitrogen;

the circuit for expanding the gaseous nitrogen is in heat exchange with the at least one heat exchanger of the circuit for separating nitrogen from the source gas mixture in order to transfer frigories from the expanded gaseous nitrogen to said separation circuit the source gas mixture in the cryogenic purifier via the at least one heat exchanger; and at an outlet of the cryogenic purifier, the produced helium has a pressure between 15 and 35 bar and a temperature between 77 and 90 K.

2. The facility of claim 1, wherein the circuit for expanding the pressurized gaseous nitrogen comprises at least two turbines for expanding the pressurized gaseous nitrogen and two separate portions in heat exchange with the at least one heat exchanger, the two separate portions being located respectively downstream of the two expansion turbines.

3. The facility of claim 1, wherein the circuit for separating nitrogen from the source gas mixture comprises at least one pressure swing adsorption unit for separating the nitrogen from the source gas mixture.

4. The facility of claim 1, wherein the helium liquefier comprises a compression station the helium in the work cycle, a device for cooling the helium originating from the compression station and a cold box that cools and expands the helium compressed in the work cycle, characterized in that the device for cooling the cycle helium originating from the compression station is incorporated in the cryogenic purifier in a thermally insulated common housing and in that the cold box of the liquefier is located in a thermally insulated separate housing that comprises vacuum insulation.

5. The facility of claim 4, wherein the cold box of the helium liquefier contains four turbines for expanding helium gas in the work cycle and the compression station contains a compressor stage of the work gas in the work cycle.

6. The facility of claim 1, wherein the helium produced by the cryogenic purifier at an outlet of the cryogenic purifier has a temperature between 80 to 85 K.

7. The facility of claim 1, wherein the helium produced by the cryogenic purifier at an outlet of the cryogenic purifier has a temperature of 82 K.

8. A process for producing liquid helium, comprising the steps of:

providing the facility of claim 1;

separating nitrogen from the source gas mixture using the cryogenic purifier at a temperature below a temperature of the source gas;

transferring the produced helium from the cryogenic purifier to the helium liguefier via the helium transfer line;

in the helium liguefier, subjecting the helium received from the helium transfer line to the work cycle comprising in series: the compression of the helium, the cooling and an expansion of the compressed helium and the reheating of the cooled and expanded helium, wherein:

the source gas mixture comprises nitrogen at a molar concentration between 50-65% and helium at a molar concentration between 35-50%, the source gas mixture has a pressure between 15 and 35 bar and a temperature between 273 and 323 K , and at an outlet of the purifier, the helium produced by the purifier has the pressure between 15-35 bar and the temperature between 77-90 K; expanding the pressurized gaseous nitrogen from the source of pressurized gaseous nitrogen with the expansion circuit of the cryogenic purifier; and transferring frigories from the expanded pressurized gaseous nitrogen to the helium in the cryogenic purifier via the at least one heat exchanger.

9. The process of claim 8, wherein the source gas mixture further comprises at least one element at a molar concentration of between 0.15% and 0.50%, the at least one element being one or more of argon, oxygen, and neon.

10. The process of claim 9, wherein the at least one element is present in the source gas mixture at a molar concentration of 0.22%.

11. The process of claim 8, wherein the source gas mixture essentially consists of nitrogen at a molar concentration between 50-65% and helium at a molar concentration between 35-50%.

12. The process of claim 8, wherein nitrogen is present in the source gas at a molar concentration between 55% and 60% and helium is present in the source gas at a molar concentration between 40% and 45%.

13. The process of claim 8, wherein the source gas mixture essentially consists of nitrogen and helium, nitrogen is present in the source gas mixture at a molar concentration of 57% and helium is present in the source gas mixture at a molar concentration of 42%.

14. The process of claim 8, wherein the source gas mixture has a temperature of 300 K.

15. The process of claim 8, wherein at an outlet of the cryogenic purifier, the helium produced by the cryogenic purifier has a temperature between 80-85 K.

16. The process of claim 8, wherein at an outlet of the cryogenic purifier, the helium produced by the cryogenic purifier has a temperature of 82 K.

17. The process of claim 8, wherein the pressurized gaseous nitrogen is at a pressure between 15 and 50 bar and a temperature between 273 and 323 K.

18. The process of claim 17, wherein the pressurized gaseous nitrogen has a pressure of 40 bar.

19. The process of claim 8, wherein the helium liquefier is configured to only cool the helium in the work cycle from the temperature of the helium at the outlet of the purifier down to 4 K.

* * * * *